US006082694A

United States Patent [19]

Joyce

[11] Patent Number: 6,082,694

[45] Date of Patent: Jul. 4, 2000

[54] GOLF UMBRELLA MOUNTING CLAMP

[76] Inventor: Robert Greene Joyce, 834 N. College St., Auburn, Ala. 36830

[21] Appl. No.: 09/146,179

[22] Filed: Sep. 3, 1998

[51] Int. Cl.[7] ..... A47G 5/00

[52] U.S. Cl. ..... 248/288.31; 135/16; 403/143; 248/96

[58] Field of Search ..... 248/288.31, 288.51, 248/96; 403/143, 141, 76; 135/16

[56] References Cited

U.S. PATENT DOCUMENTS

| | | | |
|---|---|---|---|
| 892,105 | 6/1908 | White | 172/184 |
| 958,052 | 5/1910 | Williams | 403/143 X |
| 3,602,466 | 8/1971 | Drowns | 248/514 |
| 3,866,934 | 2/1975 | Braun | 135/16 X |
| 4,980,805 | 12/1990 | Maglica | 403/141 X |

*Primary Examiner*—Ramon O. Ramirez
*Attorney, Agent, or Firm*—Veal & Associates

[57] ABSTRACT

A mounting apparatus that can be universally adapted to golf umbrellas or which can be used with a specialized umbrella. Further, the invention is compact and thus lightweight so as not to detract from nor significantly effect the standard usage of the golf bag. The invention utilizes a spherical adapter which is attached to the bottom of the handle of the umbrella. The adapter is in turn captured within a clamp having a socket formed in it. The clamp is in turn secured to the golf bag. Normally, the clamp will remain with the bag and the spherical member will remain with the umbrella when the two are separated such that additional accessories such as cup holders and scorecard holders may be used instead of the umbrella.

6 Claims, 5 Drawing Sheets

GOLF UMBRELLA MOUNTING CLAMP

FIELD OF THE INVENTION

The present invention relates to golf apparatus and more particularly to golf bag accessories. In even greater particularity the present invention relates to a means for attaching an adapted or specialized umbrella to the golf bag such that it does not have to be separately carried by the golfer either while walking or when the bag has been placed at rest on the ground.

BACKGROUND OF THE INVENTION

Although many golfers use carts on which they and their clubs are carried from hole to hole on the course, the majority of golfers continue to walk the course. Golfers find themselves carrying their bag, perhaps a canned beverage, a scorecard, and on sunny or rainy days an umbrella. The assortment of items carried or attempted varies from golfer to golfer; however, many forgo the protection an umbrella affords simply because there is no convenient way to carry the umbrella and the remaining items.

SUMMARY OF THE INVENTION

It is an object of the present invention to allow an adapted or specialized golf umbrella to be attached to a golf bag in such a manner as to facilitate its use and to free the hands of the golfer while carrying and standing near the bag.

It is a further object of the invention to provide a compact and thus lightweight means for mounting an adapted or specialized umbrella to a golf bag that does not detract from nor significantly effect the standard usage of the golf bag.

It is a further object of the invention to provide a mounting means that allows an adapted or specialized golf umbrella to be readily engaged to a golf bag for use in conjunction with the golf bag and readily disengaged from the golf bag for normal use.

It is a further object of the invention to allow the golf umbrella to be easily adjusted in attitude and height to suit the conditions of use.

These and other objects are advantageously accomplished in the present invention by the use of a mounting apparatus that can be universally adapted to golf umbrellas or which can be used with a specialized umbrella. Further, the invention does not detract from nor significantly effect the standard usage of the golf bag. The invention utilizes a spherical adapter which is attached to the bottom of the handle of the umbrella. The adapter is in turn captured within a clamp having a socket formed in it. The clamp is in turn secured to the golf bag. Normally, the clamp will remain with the bag and the spherical member will remain with the umbrella when the two are separated.

BRIEF DESCRIPTION OF THE DRAWINGS

Apparatus embodying features of my invention are depicted in the accompanying drawings which a portion of this disclosure and wherein.

PREFERRED EMBODIMENT OF THE INVENTION

Figure 1:
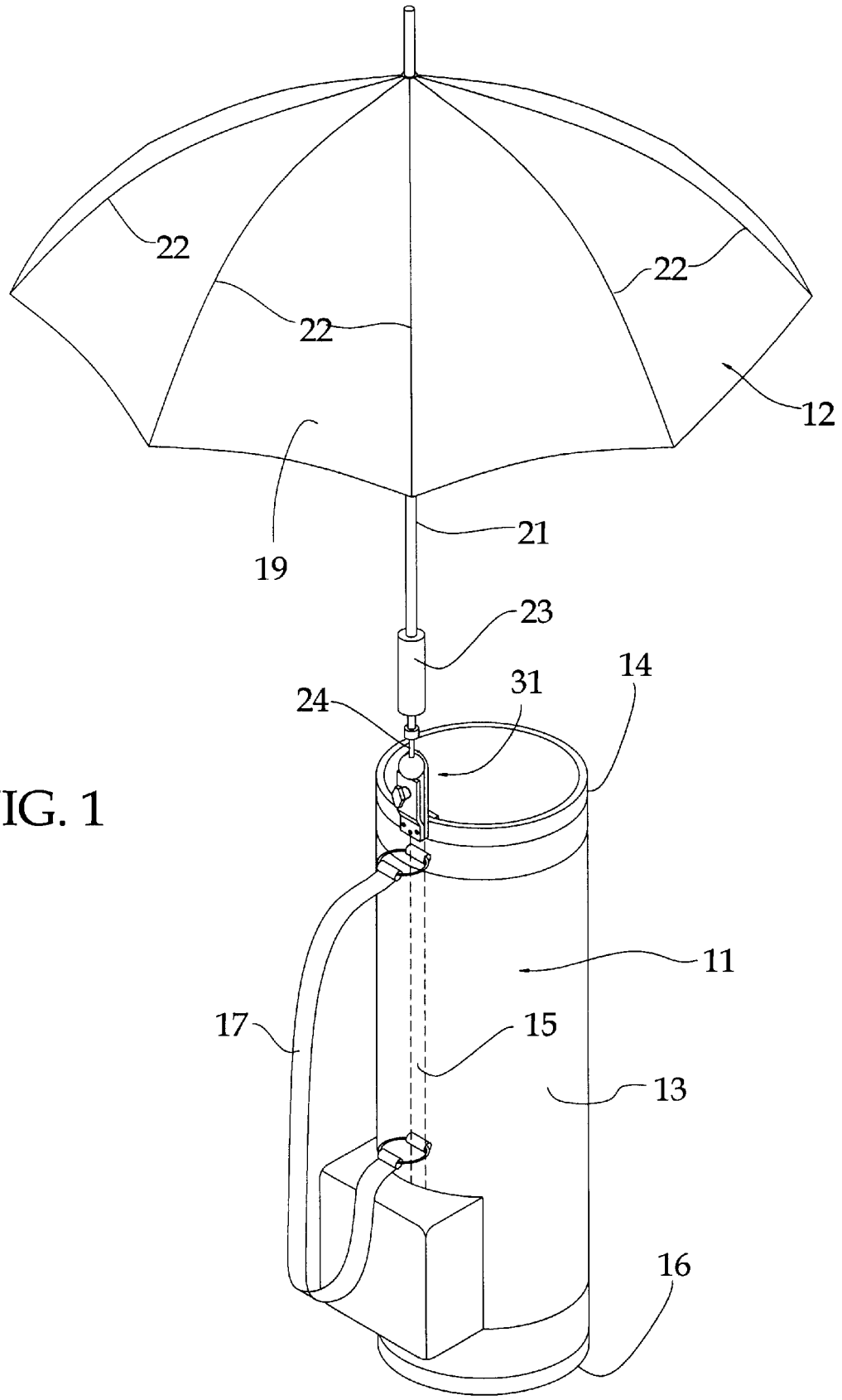
FIG. 1 is a perspective view of the invention in use with a bag and umbrella.

Referring to the drawings for a clearer understanding of the invention, it may be seen in FIG. 1, that the invention is utilized to unitize a golf bag 11 and umbrella 12. The golf bag 11 may be of conventional construction having a generally cylindrical bag portion 13, circumscribed by a reinforced band 14 at the top and having one or more stays 15 extending from the band 14 to a bottom 16. A conventional strap 17 and accessory pouch may also be included. Umbrella 12, likewise may be conventional to with a fabric canopy 19 distendable from an upper portion of an umbrella shaft 21 on a plurality of radially extending ribs 22. The mechanism for extending and retracting the canopy is of conventional design and forms no portion of the invention and no description thereof is deemed necessary.

Figure 2:
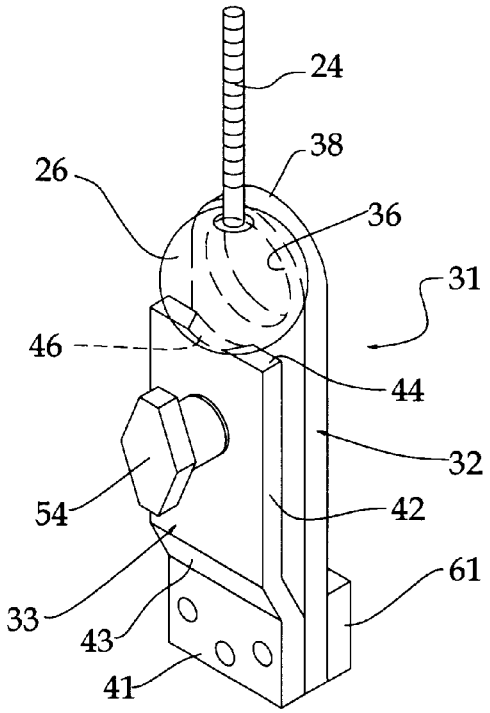
FIG. 2 is a perspective view of a first embodiment of the invention.
Figure 3:
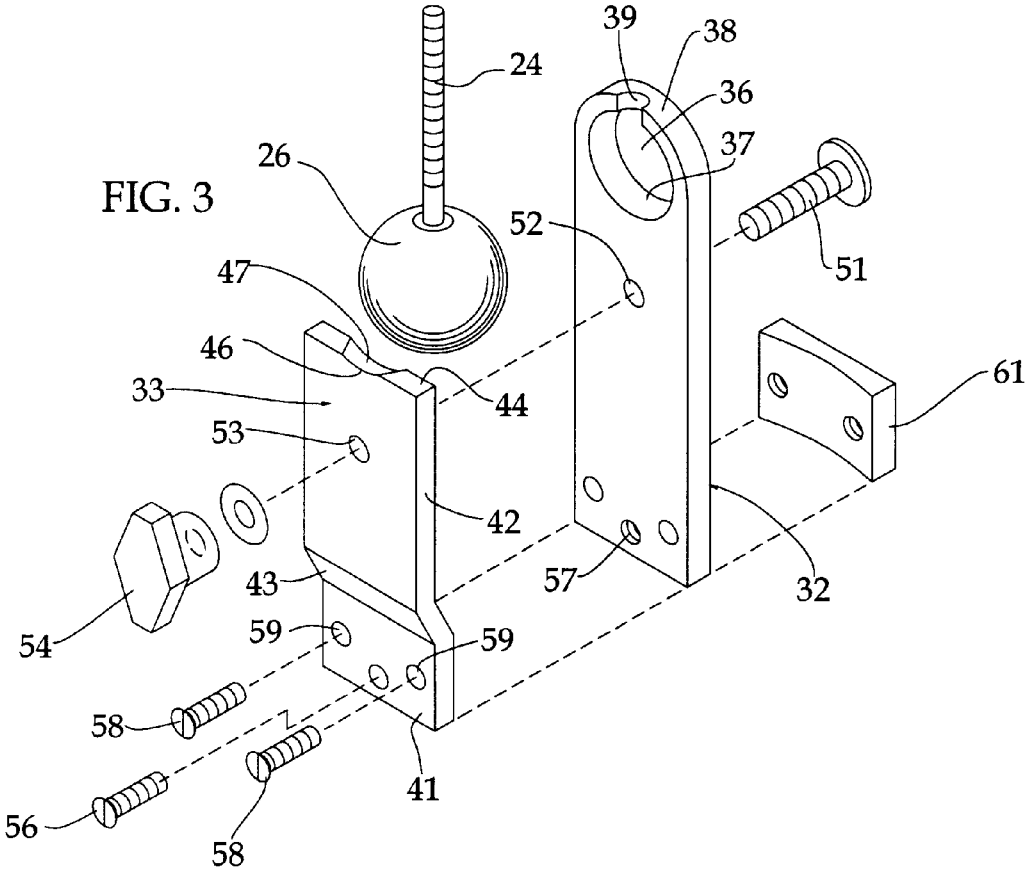
FIG. 3 is an exploded perspective view of the component parts of the first embodiment.
Figure 4:
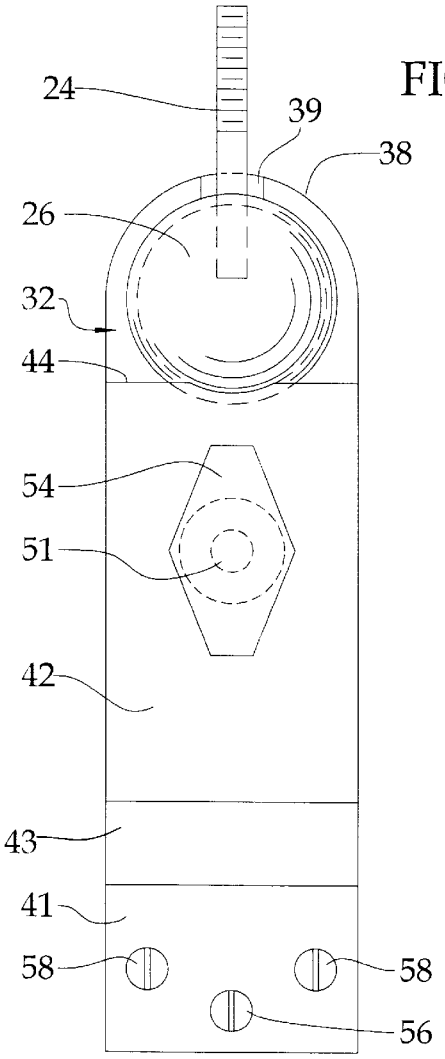
FIG. 4 is a side elevation view of the invention.
Figure 5:
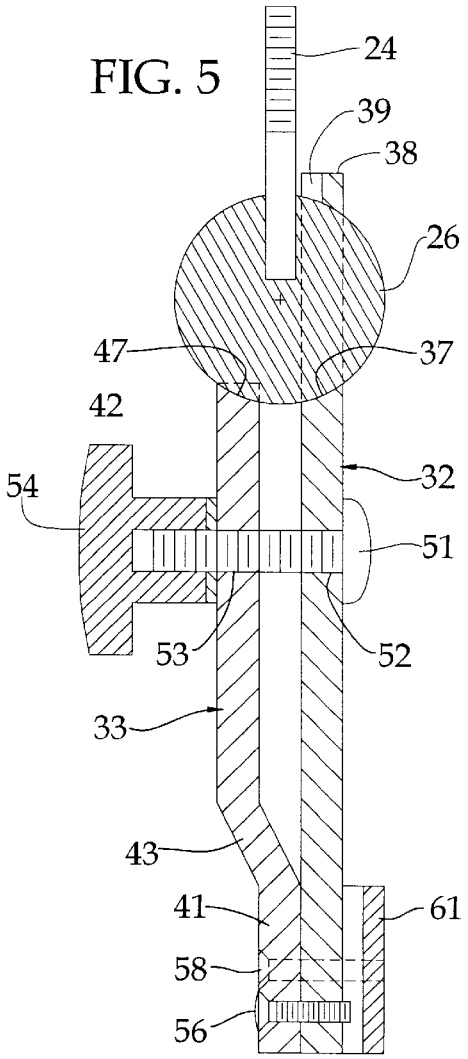
FIG. 5 is a vertical sectional view of the invention.
Figure 6:
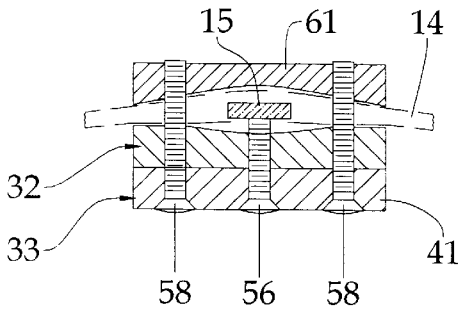
FIG. 6 is a sectional view of the invention perpendicular to FIG. 5.

Shaft 21 terminates in a handle 23, as is conventional; however, in a first embodiment, my invention includes a spherical member 26 which is affixed to the shaft 21 or handle 23 by a threaded member 24 as shown in FIG. 2 or 3. In this embodiment the spherical member 26 may be coaxially aligned with shaft 21 or offset to one side; however, the spherical member 26 must have sufficient surface to be engaged by a clamp 31. Clamp 31 includes a seat 32 and a keeper 33. Seat 32 and keeper 33 are cooperatively positioned to capture spherical member 26 therebetween. More specifically, seat 32 is an elongated plate like member of metal or a rigid plastic construction having an orifice 36 formed at one end thereof. Orifice 36 is defined by a substantially continuous wall 37 which is formed in the shape of a spherical concave segment. The dimensions of wall 37 are commensurate with a first segment of spherical member 26 not encompassing its major diameter; therefore, spherical member 26 cannot pass through orifice 36 but can fit partially therewithin. A groove 39 extending radially from the center of orifice 36 and longitudinally along seat 32 interrupts the wall 37 and extends from the orifice 36 to the proximal end 38 of seat 32. Groove 39 has a width commensurate with the width of the threaded member 24 such that member 24 may be optionally received therewithin.

Keeper 33 includes a lower portion 41 which abuts seat 32 at a lower end thereof and an extension 42 offset from lower portion 41 by a step 43 such that extension 42 is spaced from seat 32. Extension 42 terminates at end 44 which has formed therein a semi-spherical depression 46 having a surface 47 which conforms to a semi-segment of spherical member 26. Extension 42 is spaced sufficiently from seat 33 that surface 47 will overly a portion of a second segment of spherical member 26 not encompassing its major diameter, when the spherical member 26 is engaged in orifice 36. The engaged first and second segments of spherical member 26 intersect in the region proximal groove 39 and diverge on opposite sides of the major diameter of spherical member 26. In this manner, spherical member 26 is captured by seat 32 and keeper 33.

It will be noted in FIGS. 3 through 6 that keeper 33 and seat 32 are connected by a bolt 51 passing through an aperture 52 in seat 32 and an aligned aperture 53 in keeper 33 and engaged with a handle 54. Handle 54 may be rotated relative to bolt 51 to move toward or away from seat 32 thus tightening or loosening the compression placed on spherical member 26 by the clamp 31. Accordingly, the spherical member may be positioned as desired and the clamp secured by handle 54 to hold the spherical member 26 in the set attitude. Seat 32 and keeper 33 are also connected by threaded connector 56 passing through an aperture in keeper 33 and received in threaded receptacle 57 in seat 32. Likewise, a pair of threaded connectors 58 pass through apertures 59 and through bag 11, usually through eyelets preformed in the bag or through preformed holes through band 14 on either side of a stay 15. On the inside of the bag the connectors are threadedly engaged in receptacles in a tie plate 61, such that the clamp is affixed to the bag and rigidly supported thereon by securing the connectors 58. As may be seen, the umbrellas affixed to spherical member 26 will thus be maintained in any selected orientation and attitude.

Figure 7:
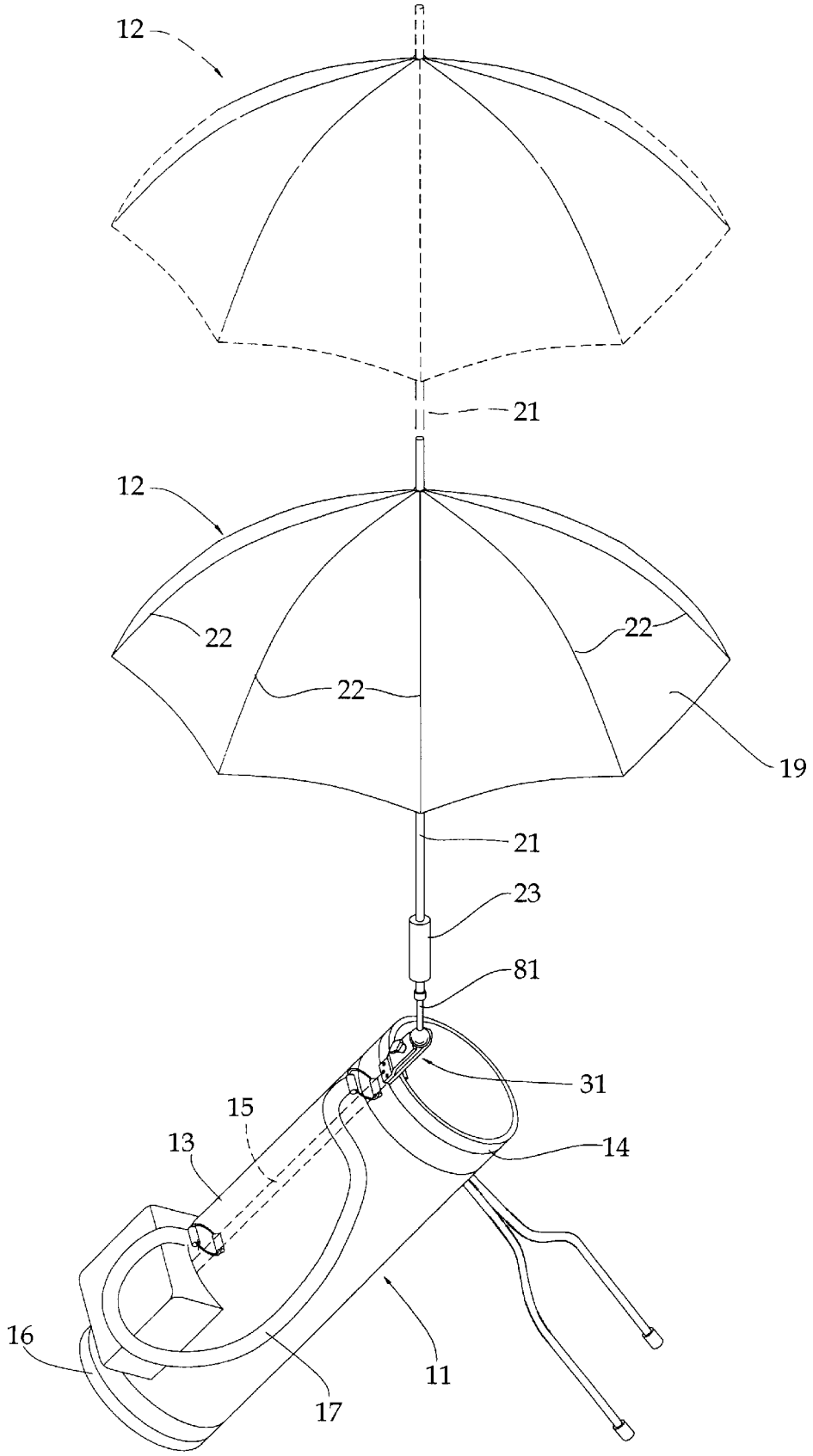
FIG. 7 is a perspective view of a second embodiment of the invention.

At times it may be desirable to adjust not only the attitude of umbrella 12 but also its height. Therefore, in the embodiment shown in FIG. 7, spherical member 12 is affixed to the lower end of a secondary internal shaft 81 which telescopes inside shaft 21, or otherwise collapses or extends relative to shaft 21 such that the height of the fabric portion of the umbrella may be adjusted. Shaft 81 and 21 are conventionally connected as by détente and pin connections or twist interference connectors which are well known in the art and are not shown in the interest of clarity.

Figure 8:
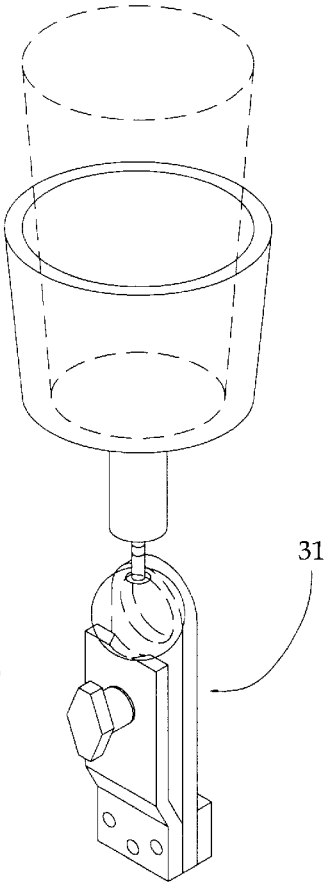
FIG. 8 is a perspective view of the clamp shown supporting a cup holder; and, FIG. 9 is a perspective view of the clamp shown supporting a scorecard holder.
Figure 9:
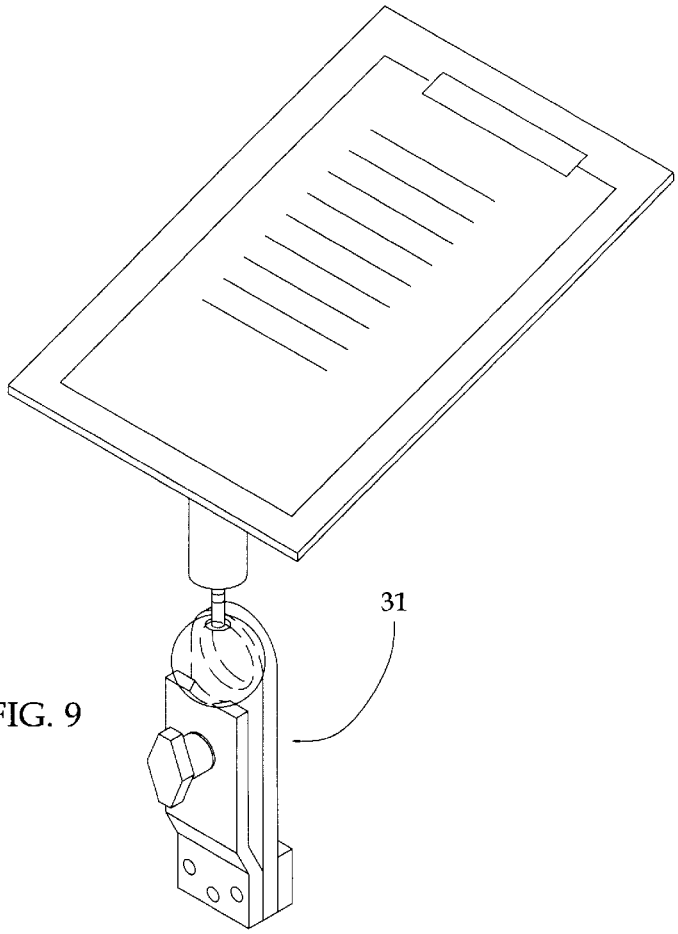

It may be seen that when the golfer is playing in very hot and sunny conditions or rainy conditions the golf umbrella may be quickly and easily attached to the bag by inserting the spherical member into the clamp, which normally remains attached to the bag. Similarly, the golf umbrella may be quickly and easily separated from the bag by removing the spherical member from the clamp. When attachment of the umbrella to the bag is not desired, the clamp remains unobtrusively connected to the band of the bag. It will be appreciated that the clamp may be used with other accessories similarly mounted on the bag, such as a cup holder, as shown in FIG. 8 or a scorecard holder as shown in FIG. 9, each mounted on their own spherical member and interchangeably connected to the bag.

What I claim is:

1. Apparatus for attaching an accessory to a golf bag, comprising in combination thertewith:

a. a spherical member adapted for affixation to a portion of a golf accessory;

b. means for selectively engaging said spherical member for orientation at selected angles relative to said golf bag including a seat for receiving said spherical member partially therewithin including an elongated member having a semi spherical orifice for receiving said spherical member in conforming contact formed proximal one end and a second end and a keeper, for engaging said spherical member and urging said spherical member against said seat, including an elongated member having said depression formed on an end thereof spaced from said seat and having a second end, said keeper and seat are connected at said second ends such that said orifice and said depression are placed in confronting relation for receipt and retention of said spherical member therebetween wherein said orifice and said depression engage said spherical member along a minor chord of said spherical member;

c. means for attaching said engaging means to a golf bag.

2. Apparatus for attaching an accessory to a golf bag, comprising in combination therewith:

a. a spherical member adapted for affixation to a portion of a golf accessory;

b. means for selectively engaging said spherical member for orientation at selected angles relative to said golf bag including a seat for receiving said spherical member partially therewithin including an elongated member having a semi spherical orifice for receiving said spherical member in conforming contact formed proximal one end and a second end and a keeper, for engaging said spherical member and urging said spherical member against said seat, including an elongated member having said depression formed on an end thereof spaced from said seat and having a second end, said keeper and seat are connected at said second ends such that said orifice and said depression are placed in confronting relation for receipt and retention of said spherical member therebetween;

c. means for attaching said engaging means to a golf bag including a plate member disposable internally of a golf bag and having a least one threaded receptacle therein said receptacle aligned with an aperture in said seat and an aligned aperture in said keeper, and at least one threaded member passing through said aperture, said aligned aperture, and said bag for threaded engagement with said threaded receptacle.

3. Apparatus as defined in claim 1 or 2 wherein said accessory comprises an umbrella having a handle rigidly affixed to said spherical member.

4. Apparatus as defined in claim 3 further comprising an extension member slidably received in said handle such that said handle may be selectively lengthened.

5. Apparatus as defined in claim 1 or 2 wherein said accessory comprises a cup holder connected to said spherical member.

6. Apparatus as defined in claim 1 or 2 wherein said accessory comprises scorecard holder connected to said spherical member.

* * * * *